US010329738B2

(12) United States Patent
Choi et al.

(10) Patent No.: US 10,329,738 B2
(45) Date of Patent: Jun. 25, 2019

(54) CONSTRUCTION MACHINE AND METHOD FOR CONTROLLING CONSTRUCTION MACHINE

(71) Applicant: DOOSAN INFRACORE CO., LTD., Incheon (KR)

(72) Inventors: Dae Gyun Choi, Incheon (KR); Ki Yong Kim, Seoul (KR); Tae Seob Jeong, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 15/754,223

(22) PCT Filed: Aug. 22, 2016

(86) PCT No.: PCT/KR2016/009238
§ 371 (c)(1),
(2) Date: Feb. 21, 2018

(87) PCT Pub. No.: WO2017/034259
PCT Pub. Date: Mar. 2, 2017

(65) Prior Publication Data

US 2018/0238026 A1 Aug. 23, 2018

(30) Foreign Application Priority Data

Aug. 21, 2015 (KR) ..... 10-2015-0117863

(51) Int. Cl.
*E02F 9/22* (2006.01)
*E02F 3/43* (2006.01)
*E02F 3/32* (2006.01)

(52) U.S. Cl.
CPC ..... *E02F 9/2203* (2013.01); *E02F 9/2228* (2013.01); *E02F 9/2292* (2013.01);
(Continued)

(58) Field of Classification Search
USPC ..... 701/50
See application file for complete search history.

(56) References Cited

U.S. PATENT DOCUMENTS 5,839,279 A * 11/1998 Moriya ..... E02F 9/2285 60/445
6,654,676 B2 * 11/2003 Nakagawa ..... B62D 11/183 180/6.2

(Continued)

FOREIGN PATENT DOCUMENTS

JP 2000087908 3/2000
JP 2002201675 7/2002

(Continued)

*Primary Examiner* — Tan Q Nguyen
(74) *Attorney, Agent, or Firm* — K&L Gates LLP

(57) ABSTRACT

Disclosed are a construction machine such as an excavator having a hydraulic system and a method for controlling the construction machine. The construction machine includes: a hydraulic pump which is operated by a driving source to supply a working fluid; an actuator which operates by being supplied with the working fluid from the hydraulic pump; a spool which controls a flow of the working fluid supplied to the actuator from the hydraulic pump; an operating unit which controls an operation of the actuator; a memory unit which stores at least two operating speed profiles for the actuator; an operating speed selecting unit which selects any one of the at least two operating speed profiles stored in the memory unit; and a control unit which controls a discharge flow rate of the hydraulic pump based on the operating speed profile selected by the operating speed selecting unit.

11 Claims, 5 Drawing Sheets

(52) U.S. Cl.
CPC ..... *E02F 9/2296* (2013.01); *E02F 3/32* (2013.01); *E02F 3/43* (2013.01)

(56) References Cited

U.S. PATENT DOCUMENTS

| | | | | |
|---|---|---|---|---|
| 2015/0075148 | A1* | 3/2015 | Yamaji ..... | F04B 49/06 60/420 |
| 2015/0135693 | A1* | 5/2015 | Murakami ..... | F15B 13/01 60/327 |

FOREIGN PATENT DOCUMENTS

| | | |
|---|---|---|
| KR | 100337091 | 12/2002 |
| KR | 1020120086062 | 2/2012 |
| KR | 1020130075663 | 5/2013 |

* cited by examiner

[Fig. 1]
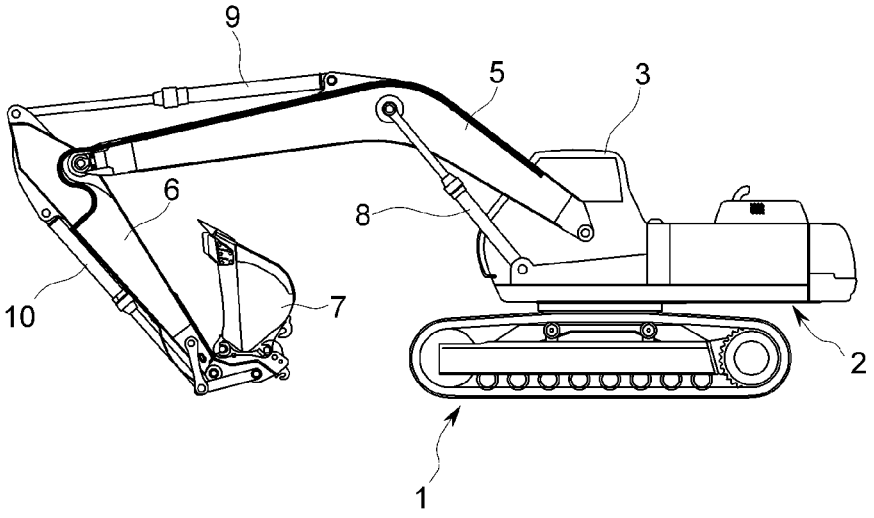

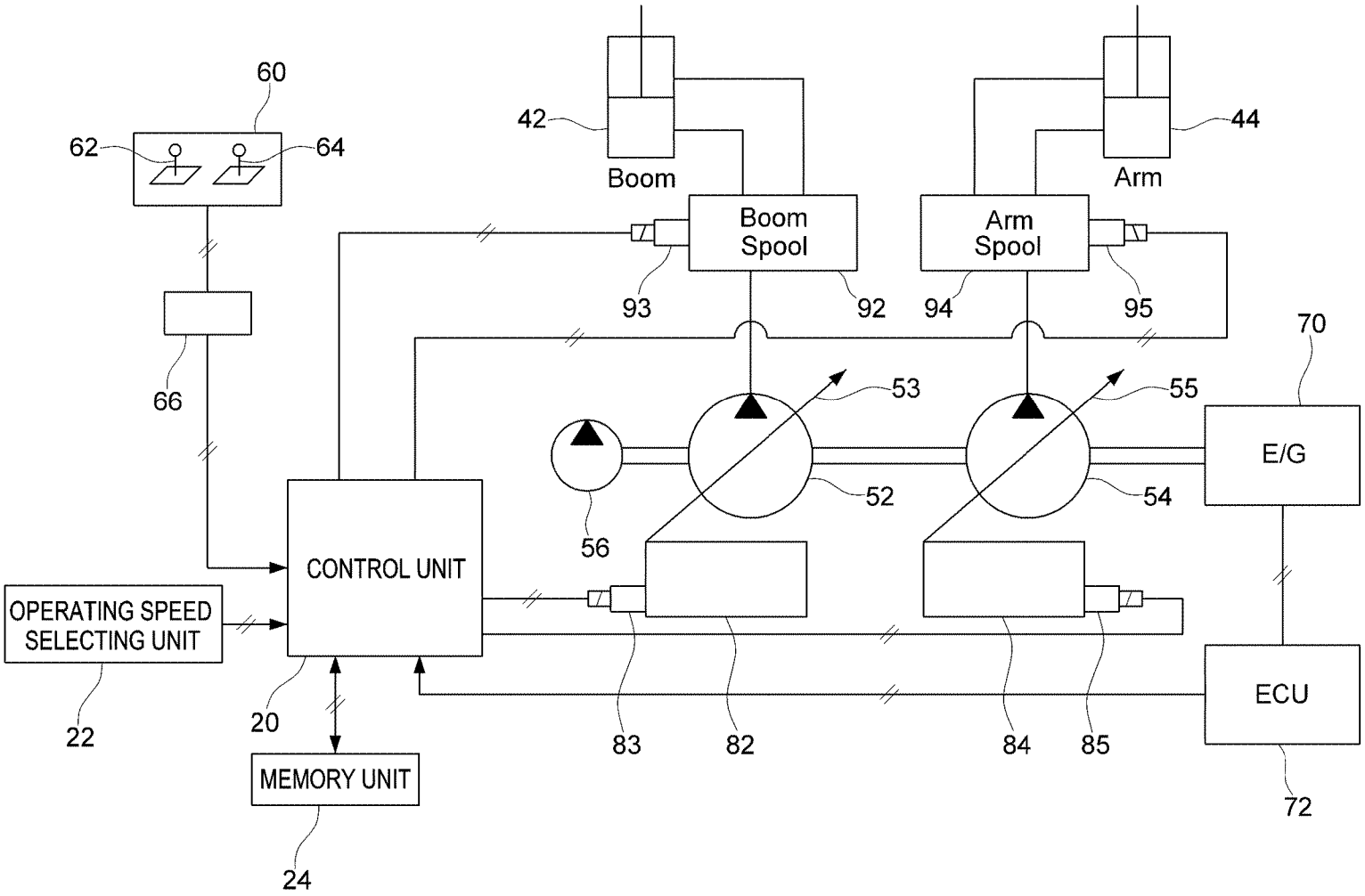
[Fig. 2]

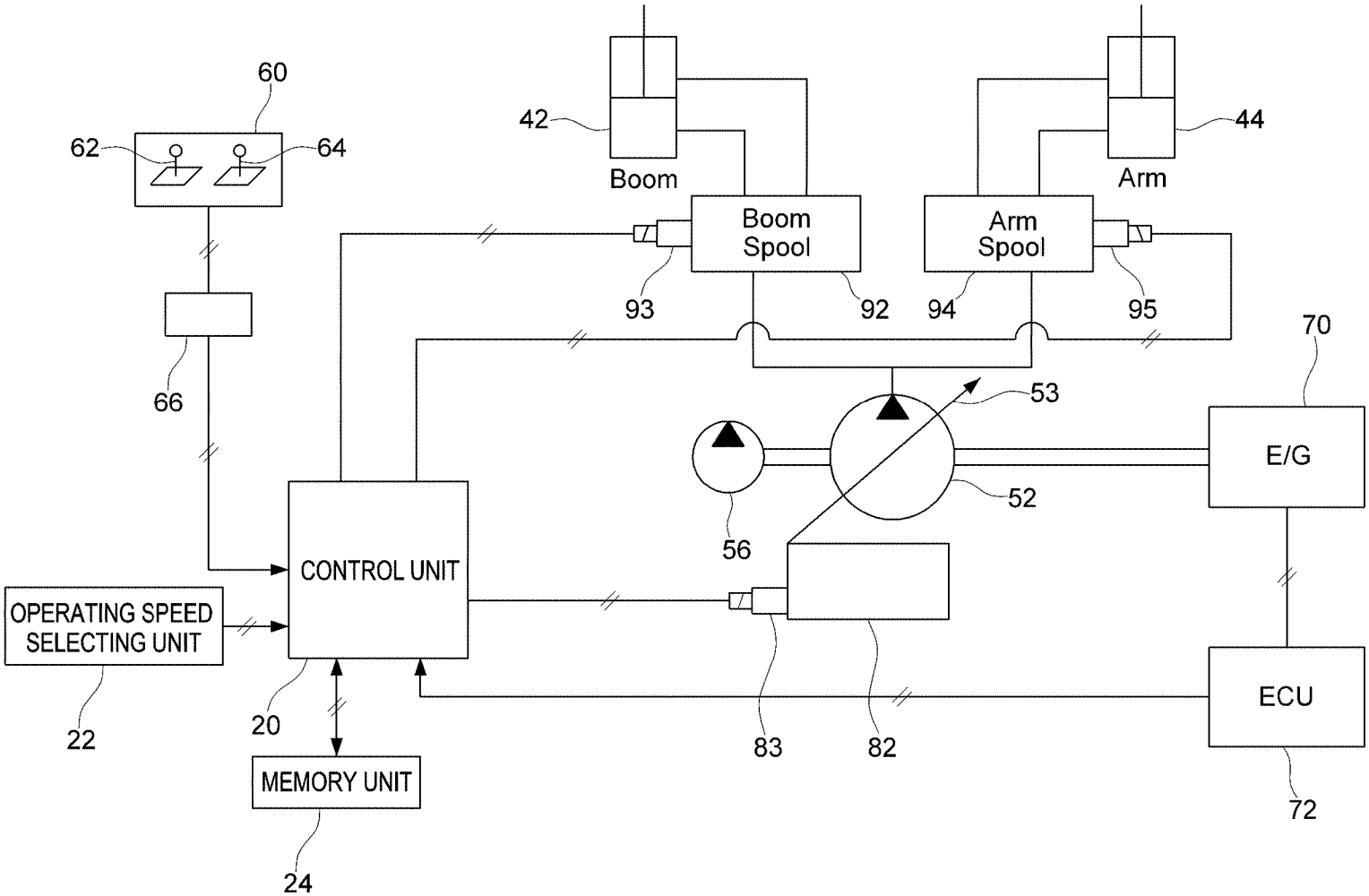
[Fig. 3]

[Fig. 4]
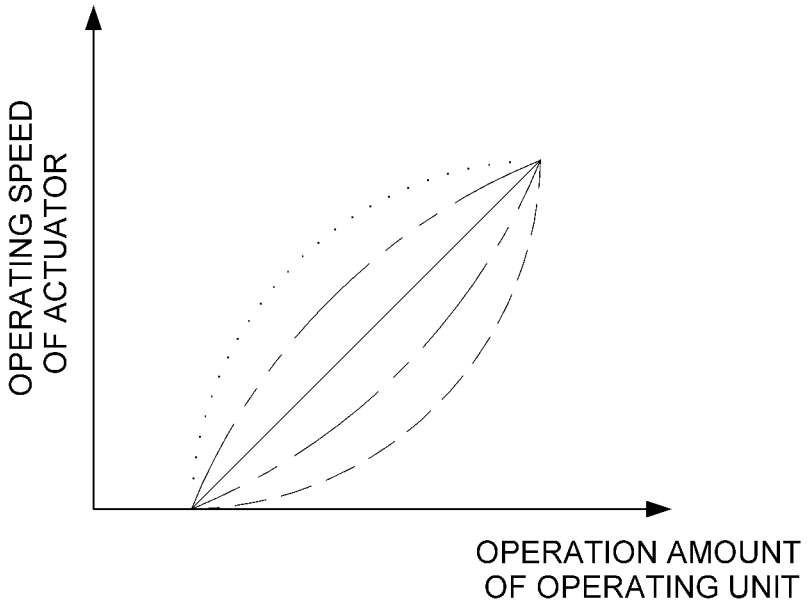
[Fig. 5]
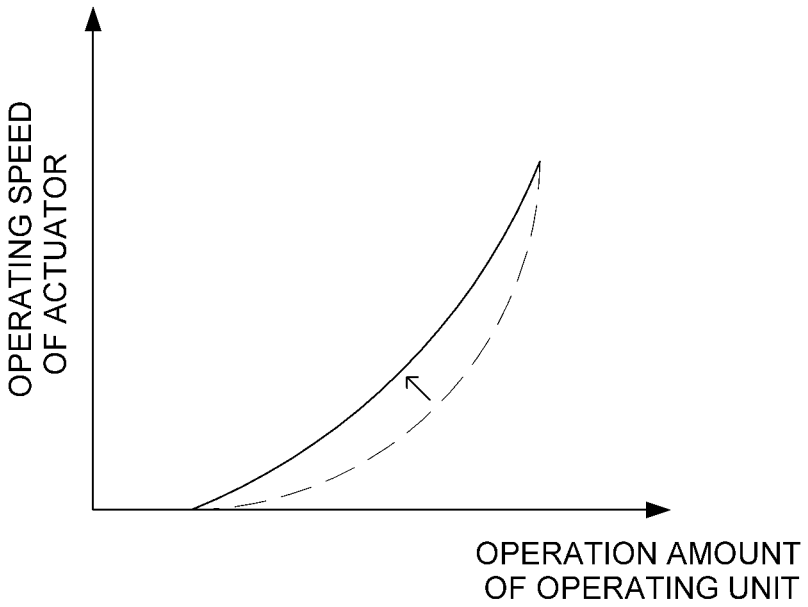

[Fig. 6]
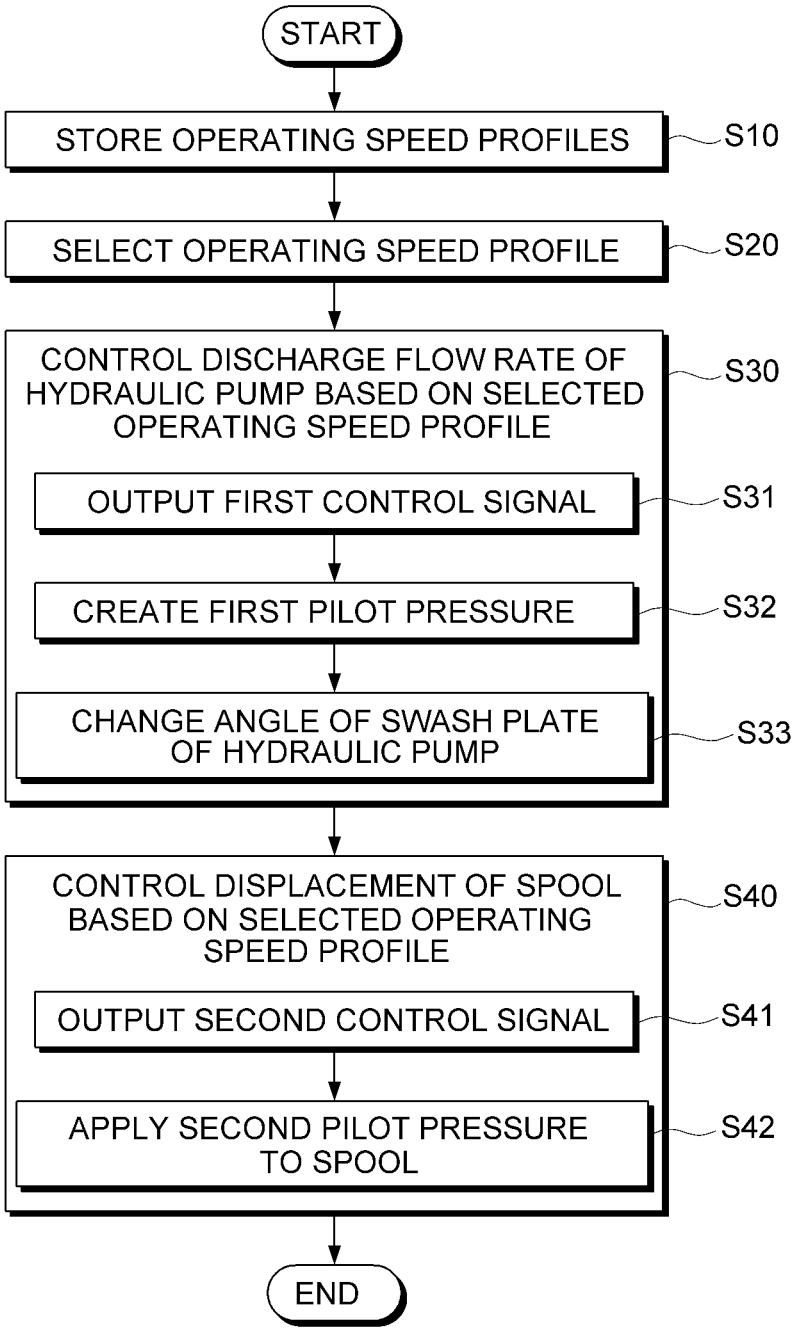

CONSTRUCTION MACHINE AND METHOD FOR CONTROLLING CONSTRUCTION MACHINE

CROSS REFERENCE TO RELATED APPLICATIONS

The present application is a National Stage of International Application No. PCT/KR2016/009238, filed on Aug. 22, 2016, which claims priority to Korean Patent Application No. 10-2015-0117863, filed on Aug. 21, 2015, the entire contents of each of which are being incorporated herein by reference.

TECHNICAL FIELD

The present disclosure relates to a construction machine and a method for controlling the construction machine, and more particularly, to a construction machine such as an excavator having a hydraulic system, and a method for controlling the construction machine.

BACKGROUND ART

In general, an excavator is a construction machine for performing operations of digging the ground, loading the soil, transporting the soil, and unloading the soil at construction sites. FIG. 1 is a view illustrating a general excavator. The excavator includes a lower traveling body 1 which supports the excavator and allows the excavator to travel, an upper turning body 2 which is provided with a cabin 3 and supports working units, and the working units which include a boom 5, an arm 6, and a bucket 7 and perform various operations. The boom 5, the arm 6, and the bucket 7 are pivotally coupled to the upper turning body 2, the boom 5, and the arm 6, respectively. The boom 5, the arm 6, and the bucket 7 are operated by a boom cylinder 8, an arm cylinder 9, and a bucket cylinder 10, respectively.

The working units such as the boom 5, the arm 6, and the bucket 7 are operated by an operation of a joystick. The user may individually control the working units by operating the joystick. In general, an operating speed of the working unit is in proportion to an operation amount of the joystick. That is, the working unit operates at a low speed when the operation amount of the joystick is small, but the working unit operates at a high speed when the operation amount of the joystick is large.

However, a working tendency varies in accordance with users, and as a result, assuming that the working unit is operated by operating the joystick with the same operation amount, some users may think that the operating speed of the working unit is low, and other users may think that the operating speed of the working unit is high.

Document of Related Art

Patent Document (Patent Document 1) KR10-2004-0045635 A

DISCLOSURE

Technical Problem

The present disclosure has been made in an effort to solve the aforementioned problem in the related art, and an object of the present disclosure is to provide a construction machine and a method for controlling the construction machine, which are capable of adjusting a speed of an actuator of the construction machine so that the actuator may operate at various speeds with respect to the same operation amount of a joystick.

Technical Solution

To achieve the aforementioned object, the present disclosure may provide a construction machine which includes a hydraulic pump which is operated by a driving source to supply a working fluid, an actuator which operates by being supplied with the working fluid from the hydraulic pump, a spool which controls a flow of the working fluid supplied to the actuator from the hydraulic pump, and an operating unit which controls an operation of the actuator, the construction machine including: a memory unit which stores at least two operating speed profiles for the actuator; an operating speed selecting unit which selects any one of the at least two operating speed profiles stored in the memory unit; and a control unit which controls a discharge flow rate of the hydraulic pump based on the operating speed profile selected by the operating speed selecting unit.

In this case, the at least two actuators may be provided, the at least two operating speed profiles may be stored in the memory unit for each of the at least two actuators, and the control unit may control the discharge flow rate of the hydraulic pump based on a combination of the operating speed profiles selected for each of the at least two actuators.

In addition, the hydraulic pump may be a variable capacity hydraulic pump which is capable of adjusting the discharge flow rate by changing an angle of a swash plate, the construction machine may further include: a regulator which is coupled to the swash plate to change the angle of the swash plate of the hydraulic pump; and a first electronic proportional pressure reducing valve which applies first pilot pressure to the regulator by a first control signal outputted from the control unit, and the control unit may control the discharge flow rate of the hydraulic pump by outputting the first control signal to the first electronic proportional pressure reducing valve.

In addition, the control unit may control a displacement of the spool based on the operating speed profile selected by the operating speed selecting unit.

In addition, the construction machine may further include a second electronic proportional pressure reducing valve which applies second pilot pressure to the spool by a second control signal outputted from the control unit, in which the control unit controls the displacement of the spool by outputting the second control signal to the second electronic proportional pressure reducing valve.

In addition, the operating speed selecting unit may select one or two or more operations from operations of the construction machine including digging, lifting, and grading.

In addition, the present disclosure may provide a method for controlling a construction machine which includes a hydraulic pump which is operated by a driving source to supply a working fluid and has a discharge flow rate that is adjusted by changing an angle of a swash plate, an actuator which operates by being supplied with the working fluid from the hydraulic pump, a spool which controls a flow of the working fluid supplied to the actuator from the hydraulic pump, and an operating unit which controls an operation of the actuator, the method including: storing at least two operating speed profiles for the actuator in a memory unit; selecting any one of the at least two operating speed profiles stored in the memory unit; and controlling a discharge flow rate of the hydraulic pump based on the selected operating speed profile.

In this case, the at least two actuators may be provided, the at least two operating speed profiles may be stored in the memory unit for each of the at least two actuators, and the discharge flow rate of the hydraulic pump may be controlled based on a combination of the operating speed profiles selected for each of the at least two actuators.

In addition, the controlling of the discharge flow rate of the hydraulic pump based on the selected operating speed profile may include: outputting, by a control unit, a first control signal to a first electronic proportional pressure reducing valve; creating, by the first electronic proportional pressure reducing valve, first pilot pressure based on the first control signal; and changing, by a regulator, the angle of the swash plate of the hydraulic pump based on the first pilot pressure.

In addition, the method may further include controlling a displacement of the spool based on the selected operating speed profile.

In addition, the controlling of the displacement of the spool based on the selected operating speed profile may include: outputting, by a control unit, a second control signal to a second electronic proportional pressure reducing valve; and applying, by the second electronic proportional pressure reducing valve, second pilot pressure to the spool based on the second control signal.

Advantageous Effects

According to the exemplary embodiment of the present disclosure, multiple operating speed profiles are provided for each actuator of the construction machine, such that the user may select the operating speed profile, in respect to each actuator, which is conformable to the user's working tendency, thereby improving working efficiency.

DESCRIPTION OF DRAWINGS

FIG. 1 is a view illustrating a general excavator.

FIG. 2 is a view illustrating an overall configuration of a construction machine according to an exemplary embodiment of the present disclosure.

FIG. 3 is a view illustrating an overall configuration of a hydraulic system included in a construction machine according to another exemplary embodiment of the present disclosure.

FIG. 4 is a view illustrating an example of an operating speed profile for an actuator of the construction machine according to the exemplary embodiment of the present disclosure.

FIG. 5 is a view illustrating an example in which the operating speed profile for the construction machine according to the exemplary embodiment of the present disclosure is changed.

FIG. 6 is a flowchart of a method for controlling the construction machine according to the exemplary embodiment of the present disclosure.

DESCRIPTION OF MAIN REFERENCE NUMERALS OF DRAWINGS

20: Control unit
22: Operating speed selecting unit
24: Memory unit
42, 44: Actuator
52, 54: Hydraulic pump
53, 55: Swash plate
60: Operating unit
70: Engine
82, 84: Regulator
83, 85: First electronic proportional pressure reducing valve
92, 94: Spool
93, 95: Second electronic proportional pressure reducing valve

BEST MODE

Hereinafter, exemplary embodiments of the present disclosure will be described in detail with reference to the accompanying drawings. First, in denoting reference numerals to constituent elements of the respective drawings, it should be noted that the same constituent elements will be designated by the same reference numerals, if possible, even though the constituent elements are illustrated in different drawings. Further, in the following description of the present exemplary embodiments, a detailed description of publicly known configurations or functions incorporated herein will be omitted when it is determined that the detailed description obscures the subject matters of the present exemplary embodiments.

FIG. 2 is a view illustrating an overall configuration of a construction machine according to an exemplary embodiment of the present disclosure, and FIG. 3 is a view illustrating an overall configuration of a hydraulic system included in a construction machine according to another exemplary embodiment of the present disclosure. FIG. 4 is a view illustrating an example of an operating speed profile for an actuator of the construction machine according to the exemplary embodiment of the present disclosure, and FIG. 5 is a view illustrating an example in which the operating speed profile for the construction machine according to the exemplary embodiment of the present disclosure is changed.

Referring to FIG. 2, a construction machine according to an exemplary embodiment of the present disclosure may include hydraulic pumps 52, 54, and 56, actuators 42 and 44, an operating unit 60, a control unit 20, spools 92 and 94, an operating speed selecting unit 22, and a memory unit 24. The construction machine according to the exemplary embodiment of the present disclosure may be an excavator. Hereinafter, an example in which the construction machine according to the exemplary embodiment of the present disclosure is the excavator will be described.

The hydraulic pumps 52, 54, and 56 may include main pumps 52 and 54 and a sub pump 56. The main pumps 52 and 54 may include a first pump 52 and a second pump 54. The first and second pumps 52 and 54 may supply a working fluid to the actuators 42 and 44 so that the construction machine performs a particular operation. The sub pump 56 may supply a pilot working fluid to first electronic proportional pressure reducing valves 83 and 85 and second electronic proportional pressure reducing valves 93 and 95, and may supply the working fluid to additional hydraulic devices. The first and second pumps 52 and 54 and the sub pump 56 may be operated by a driving source such as an engine 70, and the engine 70 may be controlled by an electronic control unit (ECU) 72. The electronic control unit 72 may provide the control unit 20 with information about an engine rotational speed, output torque, and the like of the engine 70.

The first and second pumps 52 and 54 may be bidirectional pumps which may discharge the working fluid in two directions, and may be variable capacity pumps capable of adjusting a discharge flow rate by changing swash plate angles, that is, by changing inclination angles of swash plates 53 and 55. The swash plates 53 and 55 of the first and second pumps 52 and 54 may be provided with swash plate angle sensors (not illustrated), and the swash plate angle sensors may detect the swash plate angles of the first and second pumps 52 and 54 and output the swash plate angles to the control unit 20.

The actuators 42 and 44 include a first actuator 42 and a second actuator 44. The actuators 42 and 44 may be hydraulic cylinders or hydraulic motors. The first actuator 42 may operate by being supplied with the working fluid from the first pump 52, and the second actuator 44 may operate by being supplied with the working fluid from the second pump 54.

The operating unit 60 may include first and second joysticks 62 and 64. An operation amount of the operating unit 60 is detected by an operation amount sensor 66, and the detected value may be outputted to the control unit 20. The operation amount of the operating unit 60 means a degree to which the operating unit 60 is operated by a user. The operation amount of the operating unit 60 may be various types of values such as a displacement or an angle of the operating unit 60 and magnitudes of signals, voltage, and current generated by the operation of the operating unit 60. The operation amount sensor 66 may directly acquire the operation amount of the operating unit 60 like an angle sensor for measuring an angle of the operating unit 60, or may indirectly acquire the operation amount of the operating unit 60 by measuring pressure or calculating a signal when the pressure or the signal is generated by the operation of the operating unit 60. When the operating unit 60 is operated by the user, the operation amount of the operating unit 60 is acquired by the operation amount sensor 66, and the operation amount sensor 66 outputs the operation amount of the operating unit 60 to the control unit 20.

In accordance with the operations of the first and second joysticks 62 and 64, the control unit 20 outputs a first control signal for changing the angles of the swash plates 53 and 55 of the first and second pumps 52 and 54, thereby changing discharge flow rates and discharge pressure of the first and second pumps 52 and 54. The first electronic proportional pressure reducing (EPPR) valves 83 and 85 and regulators 82 and 84 may be provided to adjust the angles of the swash plates 53 and 55 of the first and second pumps 52 and 54 based on the first control signal of the control unit 20. The regulators 82 and 84 may be coupled to the swash plates 53 and 55 of the first and second pumps 52 and 54, respectively, and the first electronic proportional pressure reducing valves 83 and 85 may be connected to the regulators 82 and 84, respectively. The first electronic proportional pressure reducing valves 83 and 85 are operated based on the first control signal received from the control unit 20 and create first pilot pressure, and the first pilot pressure, which is created by the first electronic proportional pressure reducing valves 83 and 85, is transmitted to the regulators 82 and 84. In this case, the working fluid, which is required to create the first pilot pressure of the first electronic proportional pressure reducing valves 83 and 85, may be supplied from the sub pump 56. The regulators 82 and 84 may change the discharge flow rates of the first and second pumps 52 and 54 by changing the angles of the swash plates 53 and 55 of the first and second pumps 52 and 54 based on first pilot pressure signals of the first electronic proportional pressure reducing valves 83 and 85.

The spools 92 and 94 may include a first spool 92 and a second spool 94. The first spool 92 is positioned on a flow path that connects the first pump 52 and the first actuator 42, such that the first spool 92 controls a flow of the working fluid supplied to the first actuator 42 from the first pump 52. The second spool 94 is positioned on a flow path that connects the second pump 54 and the second actuator 44, such that the second spool 94 controls a flow of the working fluid supplied to the second actuator 44 from the second pump 54.

The flow rate of the working fluid supplied to the actuators 42 and 44 is increased when the displacements of the spools 92 and 94 are large, in other words, when ports of the spools 92 and 94 are opened widely, but the flow rate of the working fluid supplied to the actuators 42 and 44 is decreased when the displacements of the spools 92 and 94 are small, in other words, when the ports of the spools 92 and 94 is opened narrowly.

The displacements of the spools 92 and 94 may be controlled by the second electronic proportional pressure reducing valves 93 and 95. The second electronic proportional pressure reducing valves 93 and 95 may be provided on the first spool 92 and the second spool 94, respectively. The second electronic proportional pressure reducing valves 93 and 95 create second pilot pressure based on a second control signal received from the control unit 20, and the second pilot pressure, which is created by the second electronic proportional pressure reducing valves 93 and 95, is transmitted to pressure receiving parts of the spools 92 and 94. In this case, the working fluid, which is required to create the second pilot pressure of the second electronic proportional pressure reducing valves 93 and 95, may be supplied from the sub pump 56. The displacements of the spools 92 and 94 may be controlled by second pilot pressure signals created by the second electronic proportional pressure reducing valves 93 and 95.

As described above, the hydraulic system included in the construction machine according to the exemplary embodiment of the present disclosure may be an electronic pressure control type hydraulic pump system. In the electronic pressure control type hydraulic pump system, the discharge pressure and the discharge flow rates of the first and second pumps 52 and 54 may be independently controlled by the first electronic proportional pressure reducing valves 83 and 85 and the regulators 82 and 84 which are provided in the first and second pumps 52 and 54, respectively. Meanwhile, in the present exemplary embodiment, the first electronic proportional pressure reducing valves 83 and 85 and the regulators 82 and 84 are used to change the inclination angles of the swash plates 53 and 55 of the first and second pumps 52 and 54, but a means for changing the inclination angles of the swash plates 53 and 55 of the first and second pumps 52 and 54 is not limited to the first electronic proportional pressure reducing valves 83 and 85 and the regulators 82 and 84, and various publicly known devices may be used.

The memory unit 24 stores operating speed profiles for the actuators 42 and 44 in respect to the operation amount of the operating unit 60. At least two operating speed profiles may be stored in the memory unit 24 for each of the actuators 42 and 44. An operating speed of the actuator means a speed at which an operating part of the actuator is operated by the working fluid. For example, in a case in which the actuator is a hydraulic cylinder, a cylinder rod of the actuator is extended or retracted by the working fluid, and the operating speed of the actuator means a speed at which the cylinder rod is extended or retracted. In addition, in a case in which the actuator is a hydraulic motor, a driving shaft of the actuator is rotated by the working fluid, and the operating speed of the actuator means a speed at which the driving shaft is rotated.

As illustrated in FIG. 4, the operating speed profiles for the actuators 42 and 44 mean the operating speeds of the actuators 42 and 44 which are set corresponding to the operation amount of the operating unit 60 in a range from a minimum operation amount to a maximum operation amount of the operating unit 60. In a case in which the multiple operating speed profiles for the actuators 42 and 44 are provided, the operating speeds of the actuators 42 and 44 vary in accordance with the operating speed profiles which are selected from the multiple operating speed profiles to operate the actuators 42 and 44 even though the operating unit 60 is operated with the same operation amount. Referring to FIG. 4, the operating speeds of the actuators 42 and 44 are decreased in respect to the same operation amount of the operating unit 60 when the operating speed profile positioned at a lower side of an operating speed profile graph is selected, but the operating speeds of the actuators 42 and 44 are increased in respect to the same operation amount of the operating unit 60 when the operating speed profile positioned at an upper side of the operating speed profile graph is selected. Therefore, in the case in which the multiple operating speed profiles for the actuators 42 and 44 are provided, the user may operate the construction machine by selecting the operating speed profile suitable for the user's working tendency. The operating speed profiles for the actuators 42 and 44 may be set in advance by a manufacturer of the construction machine or may be arbitrarily set by the user. The operating speed profile may be a linear profile, a nonlinear profile, or a combination of linear and nonlinear profiles.

In addition, the operating speed profile may be individually set for each of the multiple actuators 42 and 44. In the present exemplary embodiment, the two actuators 42 and 44 are provided, but three or more actuators and may be provided in accordance with the type and the structure of the construction machine. In this case, the multiple operating speed profiles may be set for each of the actuators. Therefore, the user may select the operating speed profile individually for each of the actuators.

The operating speed selecting unit 22 serves to allow the user to select any one of the multiple operating speed profiles stored in the memory unit 24. For example, the operating speed selecting unit 22 may be a touch type display device of the construction machine or may be a selection lever, a button, or a switch separately provided from the display device. When the user selects any one of the multiple operating speed profiles through the operating speed selecting unit 22, the result may be outputted to the control unit 20.

When a particular operating speed profile is selected through the operating speed selecting unit 22, the control unit 20 may output the first control signal based on the operating speed profile in order to control the first and second pumps 52 and 54 corresponding to the operation of the operating unit 60. In this case, when the operating speed profiles are selected for each of the multiple actuators, the control unit 20 may control the discharge flow rates of the first and second pumps 52 and 54 based on a combination of the selected operating speed profiles. In other words, when the operating speed profile for the first actuator 42 and the operating speed profile for the second actuator 44 are selected, the control unit 20 may control the discharge flow rates of the first and second pumps 52 and 54 by combining the operating speed profile selected for the first actuator 42 and the operating speed profile selected for the second actuator 44 so that the operating speeds of the first actuator 42 and the second actuator 44 may conform to the selected operating speed profiles. In addition, when the particular operating speed profile is selected through the operating speed selecting unit 22, the control unit 20 may output the second control signal based on the operating speed profile in order to control the first and second spools 92 and 94 corresponding to the operation of the operating unit 60. As illustrated in FIG. 5, when an operating speed profile indicated by a solid line is selected as the operating speed profile for the first actuator 42, the operating speed of the first actuator 42 in respect to the same operation amount of the operating unit 60 is increased in comparison with a case in which an operating speed profile indicated by a dotted line is selected. To implement the increased operating speed, the control unit 20 may output the first control signal for increasing the discharge flow rate of the first pump 52. In addition, the control unit 20 may output the second control signal for increasing the displacement of the first spool 92 in order to prevent a loss of pressure in the first spool 92 when the working fluid discharged from the first pump 52 is supplied to the first actuator 42 via the first spool 92.

Meanwhile, as illustrated in FIG. 3, the construction machine may be provided with only the single main pump 52. In this case, as illustrated in FIG. 5, when the operating speed profile indicated by the solid line is selected as the operating speed profile for the first actuator 42 and the operating speed profile indicated by the dotted line is selected as the operating speed profile for the second actuator 44, the control unit 20 may control the first and second spools 92 and 94 so that the first spool 92 has a larger displacement than the second spool 94.

Meanwhile, the operating speed selecting unit may also select one or two or more operations from operations of the construction machine including digging, lifting, and grading.

Hereinafter, a method for controlling the construction machine according to the exemplary embodiment of the present disclosure will be described with reference to FIG. 6. FIG. 6 is a flowchart of a method for controlling the construction machine according to the exemplary embodiment of the present disclosure. Referring to FIG. 6, a method for controlling the construction machine according to the exemplary embodiment of the present disclosure may include storing at least two operating speed profiles for the actuators 42 and 44 in the memory unit 24 (S10), selecting any one of the at least two operating speed profiles stored in the memory unit 24 (S20), and controlling the discharge flow rates of the hydraulic pumps 52 and 54 based on the selected operating speed profile (S30). The method for controlling the construction machine according to the exemplary embodiment of the present disclosure may further include controlling the displacements of the spools 92 and 94 based on the selected operating speed profile (S40). Hereinafter, the respective steps will be described in detail.

In the storing of the at least two operating speed profiles for the actuators 92 and 94 in the memory unit 24 (S10), the user or the manufacturer of the construction machine may store the operating speed profiles for the actuators 42 and 44 in the memory unit 24. In addition, the control unit 20 analyzes the user's operation pattern and may store the operating speed profiles, which are determined as being suitable for the user, in the memory unit 24. In this case, the construction machine may be provided with the at least two actuators 42 and 44, and at least two operating speed profiles may be stored in the memory unit 24 for each of the actuators 42 and 44.

In the selecting of any one of the at least two operating speed profiles stored in the memory unit 24 (S20), the user may select, through the operating speed selecting unit 22, any one of the operating speed profiles stored in the memory unit 24 for each of the actuators 42 and 44. The operating speed profile, which is set as a default value in advance by the manufacturer, may be applied to the actuator for which the operating speed profile is not selected by the user. In addition, the operating speed profile, which is determined as being suitable for the user, may be applied by the control unit 20.

In the controlling of the discharge flow rates of the hydraulic pumps 52 and 54 based on the selected operating speed profile (S30), the control unit 20 may control the discharge flow rates of the hydraulic pumps 52 and 54 based on the selected operating speed profile. In this case, the control unit 20 may control the discharge flow rates of the hydraulic pumps 52 and 54 based on the combinations of the operating speed profiles selected for each of the at least two actuators 42 and 44.

The controlling of the discharge flow rates of the hydraulic pumps 52 and 54 based on the selected operating speed profile (S30) may include outputting, by the control unit 20, the first control signal to the first electronic proportional pressure reducing valves 83 and 85 (S31), creating, by the first electronic proportional pressure reducing valves 83 and 85, the first pilot pressure based on the first control signal (S32), and changing, by the regulators 82 and 84, the angles of the swash plates 53 and 55 of the hydraulic pumps 52 and 54 based on the first pilot pressure (S33).

In the controlling of the displacements of the spools 92 and 94 based on the selected operating speed profile (S40), the control unit 20 may control the displacements of the spools 92 and 94 based on the selected operating speed profile.

In this case, the controlling of the displacements of the spools 92 and 94 based on the selected operating speed profile (S40) may include outputting, by the control unit 20, the second control signal to the second electronic proportional pressure reducing valves 93 and 95 (S41), and applying, by the second electronic proportional pressure reducing valves 93 and 95, the second pilot pressure to the spools 92 and 94 based on the second control signal (S42).

Meanwhile, the controlling of the discharge flow rates of the hydraulic pumps 52 and 54 based on the selected operating speed profile (S30) and the controlling of the displacements of the spools 92 and 94 based on the selected operating speed profile (S40) may be performed simultaneously, or one of the two steps may be performed first and then the other step may be performed, as necessary.

The above description is simply given for illustratively describing the technical spirit of the present disclosure, and those skilled in the art to which the present disclosure pertains will appreciate that various modifications, changes and substitutions are possible without departing from the essential characteristic of the present disclosure. Therefore, the present exemplary embodiments are provided for illustrative purposes only but are not intended to limit the technical concept of the present disclosure, and the scope of the technical spirit of the present disclosure is not limited by the exemplary embodiments. The protective scope of the present disclosure should be construed based on the following claims, and all the technical spirit in the equivalent scope thereto should be construed as falling within the scope of the present disclosure.

The invention claimed is:

1. A construction machine which includes a hydraulic pump which is operated by a driving source to supply a working fluid, an actuator which operates by being supplied with the working fluid from the hydraulic pump, a spool which controls a flow of the working fluid supplied to the actuator from the hydraulic pump, and an operating unit which controls an operation of the actuator, the construction machine comprising:

a memory unit which stores at least two operating speed profiles for the actuator;

an operating speed selecting unit which selects any one of the at least two operating speed profiles stored in the memory unit; and a control unit which controls a discharge flow rate of the hydraulic pump based on the operating speed profile selected by the operating speed selecting unit, wherein the control unit analyzes an operation pattern of the user and applies an operating speed profile corresponding to the analyzed operation pattern of the user among the stored operation speed profiles according to a selection result of the operating speed selecting unit.

2. The construction machine of claim 1, wherein the actuator comprises at least two actuators, the at least two operating speed profiles are stored in the memory unit for each of the at least two actuators, and the control unit controls the discharge flow rate of the hydraulic pump based on a combination of the operating speed profiles selected for each of the at least two actuators.

3. The construction machine of claim 1, wherein the hydraulic pump is a variable capacity hydraulic pump which is capable of adjusting the discharge flow rate by changing an angle of a swash plate, the construction machine further includes: a regulator which is coupled to the swash plate to change the angle of the swash plate of the hydraulic pump; and a first electronic proportional pressure reducing valve which applies first pilot pressure to the regulator by a first control signal outputted from the control unit, and the control unit controls the discharge flow rate of the hydraulic pump by outputting the first control signal to the first electronic proportional pressure reducing valve.

4. The construction machine of claim 1, wherein the control unit controls a displacement of the spool based on the operating speed profile selected by the operating speed selecting unit.

5. The construction machine of claim 4, further comprising:

a second electronic proportional pressure reducing valve which applies second pilot pressure to the spool by a second control signal outputted from the control unit, wherein the control unit controls the displacement of the spool by outputting the second control signal to the second electronic proportional pressure reducing valve.

6. The construction machine of claim 1, wherein the operating speed selecting unit selects one or more operations from operations of the construction machine including digging, lifting, and grading.

7. A method for controlling a construction machine which includes a hydraulic pump which is operated by a driving source to supply a working fluid and has a discharge flow rate that is adjusted by changing an angle of a swash plate, an actuator which operates by being supplied with the working fluid from the hydraulic pump, a spool which controls a flow of the working fluid supplied to the actuator from the hydraulic pump, and an operating unit which controls an operation of the actuator, the method comprising:

storing at least two operating speed profiles for the actuator in a memory unit;

selecting any one of the at least two operating speed profiles stored in the memory unit; and controlling a discharge flow rate of the hydraulic pump based on the selected operating speed profile, wherein if the operating speed profile is not selected by a user, analyzing the user's operation pattern, and applying an operating speed profile corresponding to the analyzed operation pattern.

8. The method of claim 7, wherein the actuator comprises at least two actuators, the at least two operating speed profiles are stored in the memory unit for each of the at least two actuators, and the discharge flow rate of the hydraulic pump is controlled based on a combination of the operating speed profiles selected for each of the at least two actuators.

9. The method of claim 7, wherein the controlling of the discharge flow rate of the hydraulic pump based on the selected operating speed profile includes:

outputting, by a control unit, a first control signal to a first electronic proportional pressure reducing valve;

creating, by the first electronic proportional pressure reducing valve, first pilot pressure based on the first control signal; and changing, by a regulator, the angle of the swash plate of the hydraulic pump based on the first pilot pressure.

10. The method of claim 7, further comprising:

controlling a displacement of the spool based on the selected operating speed profile.

11. The method of claim 10, wherein the controlling of the displacement of the spool based on the selected operating speed profile includes:

outputting, by a control unit, a second control signal to a second electronic proportional pressure reducing valve; and applying, by the second electronic proportional pressure reducing valve, second pilot pressure to the spool based on the second control signal.

* * * * *